US011933590B2

(12) United States Patent
Galvan et al.

(10) Patent No.: US 11,933,590 B2
(45) Date of Patent: Mar. 19, 2024

(54) METHOD FOR MANUFACTURING A HOUSING ENCLOSING A PYROTECHNIC LOAD

(71) Applicant: EURENCO FRANCE SAS, Sorgues (FR)

(72) Inventors: Cédric Galvan, Lamonzie Montastruc (FR); Jean-Luc Crespy, Prigonrieux (FR)

(73) Assignee: EURENCO FRANCE SAS, Sorgues (FR)

( * ) Notice: Subject to any disclaimer, the term of this patent is extended or adjusted under 35 U.S.C. 154(b) by 0 days.

(21) Appl. No.: 18/035,186

(22) PCT Filed: Oct. 20, 2021

(86) PCT No.: PCT/FR2021/051836
§ 371 (c)(1),
(2) Date: May 3, 2023

(87) PCT Pub. No.: WO2022/096795
PCT Pub. Date: May 12, 2022

(65) Prior Publication Data

US 2023/0304779 A1 Sep. 28, 2023

(30) Foreign Application Priority Data

Nov. 4, 2020 (FR) ..... 2011291

(51) Int. Cl.
*F42B 33/02* (2006.01)
*F42B 5/38* (2006.01)

(52) U.S. Cl.
CPC ..... *F42B 33/0207* (2013.01); *F42B 5/38* (2013.01); *F42B 33/025* (2013.01)

(58) Field of Classification Search
CPC ..... F42B 5/38; F42B 33/00; F42B 33/001; F42B 33/02; F42B 33/0207; F42B 33/025
See application file for complete search history.

(56) References Cited

U.S. PATENT DOCUMENTS 3,176,617 A * 4/1965 Brafford ..... F42B 5/38 102/282
3,202,730 A * 8/1965 Reed ..... F42B 33/02 264/3.1

(Continued)

FOREIGN PATENT DOCUMENTS

DE 3009841 A1 9/1981
DE 102007033832 A1 1/2009

(Continued)

OTHER PUBLICATIONS

French Search Report from corresponding FR Application No. FR 2011291, dated Jul. 19, 2021.

(Continued)

*Primary Examiner* — Gabriel J. Klein
(74) *Attorney, Agent, or Firm* — Workman Nydegger

(57) ABSTRACT

A method for manufacturing a housing enclosing a pyrotechnic charge and an installation for implementing this method includes inserting a pyrotechnic charge into a charging volume laterally delimited by a rigid cylindrical charging wall and into a lower part by a first element of the housing to be obtained; positioning a second element of the housing to be obtained of cylindrical shape above the inserted pyrotechnic charge and in the extension of the cylindrical charging wall. The second element has a lateral cylindrical wall of the same shape and diameter as the cylindrical charging wall and is able to cooperate with the first element, and jointly translating the second element and the cylindrical charging wall relative to the first element (Continued)

such as to make the second element cooperate with the first element and form the housing enclosing the pyrotechnic charge.

9 Claims, 13 Drawing Sheets

(56) References Cited

U.S. PATENT DOCUMENTS 3,831,522 A * 8/1974 Romney ..... F42B 3/00 102/318
5,052,304 A * 10/1991 Rahnenfuhrer ..... F42B 5/196 102/431
5,269,224 A * 12/1993 Gonzales ..... F42B 5/38 102/292
5,454,323 A * 10/1995 Conil ..... F42B 5/38 102/431
5,493,973 A * 2/1996 Brion ..... F42B 5/38 86/19.5
5,672,842 A 9/1997 Brion et al.
5,726,379 A * 3/1998 Kotas ..... F42B 5/38 102/431
6,360,666 B1 * 3/2002 Harris ..... F42B 33/02 86/47

FOREIGN PATENT DOCUMENTS

EP 0706025 A1 4/1996
FR 2710976 A1 4/1995

OTHER PUBLICATIONS

International Search Report from corresponding PCT Application No. PCT/FR2021/051836, dated Jan. 26, 2022.

* cited by examiner

METHOD FOR MANUFACTURING A HOUSING ENCLOSING A PYROTECHNIC LOAD

TECHNICAL FIELD

This invention relates to a method for manufacturing a housing enclosing a pyrotechnic charge and an associated installation for this manufacturing.

PRIOR ART

Combustible housings constituting modular charges for artillery ammunitions are known from document FR 2 710 976, corresponding to U.S. Pat. No. 5,454,323. This document describes the manufacturing of a combustible housing during which a housing body assembled with a charged ignition tube is filled with propulsive powder, then a cover is added such as to enclose the housing body previously filled with powder. The two parts of the housing are formed by a felting method, followed by compacting and stoving.

It does however remain desirable to avoid any risk of deformation or damage to the housing body during the operation of inserting the pyrotechnic charge.

DISCLOSURE OF THE INVENTION

This invention relates to a method for manufacturing a housing enclosing a pyrotechnic charge, said method comprising at least:

- inserting a pyrotechnic charge into a charging volume laterally delimited by a rigid cylindrical charging wall and into a lower part by a first element of the housing to be obtained,
- positioning a second element of the housing to be obtained of cylindrical shape above the inserted pyrotechnic charge and in the extension of the cylindrical charging wall, said second element having a lateral cylindrical wall of the same shape and diameter as the cylindrical charging wall and being able to cooperate with the first element, and
- jointly translating the second element and the cylindrical charging wall relative to the first element such as to make the second element cooperate with the first element and form the housing enclosing the pyrotechnic charge.

The rigid cylindrical wall is able to keep its shape when the pyrotechnic charge is inserted into the charging volume. The invention relies on the fact of performing the insertion of the pyrotechnic charge into a charging volume laterally delimited not by the housing body but by the rigid charging wall which constitutes a temporary lateral wall for the charging. Specifically during the joint translation, the second element of the housing replaces the cylindrical charging wall by positioning itself around the pyrotechnic charge. Thus, in the invention deformation or damage to the second element following the insertion of the pyrotechnic charge is avoided since the second element is only positioned after the insertion of the charge. The fact of reducing any risk of deformation or damage to the housing makes it possible to very reliably guarantee the compliance of this latter in terms of dimensions and integrity, in order to avoid any risk of scratching the weapon or any safety incident during the initiation of the pyrotechnic charge. The invention is applicable, preferably, to the manufacturing of a combustible housing but one does not depart from the scope of the invention when the housing is not combustible.

In an exemplary embodiment, the first element comprises a first base and a first hollow central neck comprising an igniting structure and extending from the first base, and the second element comprises a second base and a second hollow central neck extending from the second base, the second hollow central neck cooperating with the first hollow central neck following the joint translation.

The method makes it possible, in this housing, to charge, without deformation or damage, a volume containing the igniting structure formed by the first hollow central neck.

In an exemplary embodiment, the method further comprises the manufacturing of each of the first and second elements, this manufacturing comprising at least:

- felting on a liquid-permeable mold by suction of a felting bath comprising fibers in suspension and a resin, to obtain a blank of the element under consideration on the mold, and
- compacting the obtained blank and stoving this compacted blank.

In particular, the felting bath can be a suspension comprising nitrocellulose fibers, cellulose fibers and a resin.

In an exemplary embodiment, the pyrotechnic charge is a propulsive charge for artillery ammunition. The invention is not however limited to this application and the pyrotechnic charges can be intended for other applications such as propulsive charges of fireworks (lift charges).

In an exemplary embodiment, the pyrotechnic charge is granular.

The invention has a special interest in this case, insofar as the operation of packing the grains is liable to generate an unacceptable deformation of the housing body or of a component located inside, such as an igniting structure, if it is carried out when the charge has been previously inserted into the housing body.

Note that, when it is granular, the pyrotechnic charge can have grains of any shape, for example cylindrical, spherical or in the form of flakes or platelets.

This invention also pertains to an installation for implementing a method as described above, said installation comprising at least:

- the charging volume laterally delimited by the rigid cylindrical charging wall and by a support in a lower part,
- the pyrotechnic charge,
- an inserting device configured to insert the pyrotechnic charge into the charging volume,
- a moving system configured to position the second element above the charging volume and in the extension of the cylindrical charging wall, and perform the joint translation of the second element and of the cylindrical charging wall relative to the support, and
- a control unit configured to actuate the inserting device and the moving system.

In an exemplary embodiment, the installation further comprises:

- a felting bath comprising fibers in suspension and a resin,
- a liquid-permeable mold provided with a suction device to suck up the felting bath,
- a compacting and stoving system, and
- a second moving system configured to position the mold in the felting bath and to transport it from the felting bath to the compacting and stoving system.

The felting bath can be such as described above.

In an exemplary embodiment, the pyrotechnic charge is a propulsive charge for artillery ammunition, not being limited to such an application as indicated above.

In an exemplary embodiment, the pyrotechnic charge is granular.

DESCRIPTION OF THE EMBODIMENTS

FIG. 1A to 1D illustrate a succession of possible steps to form an example of a first element 10 of the housing to be obtained.

Figure 1A:
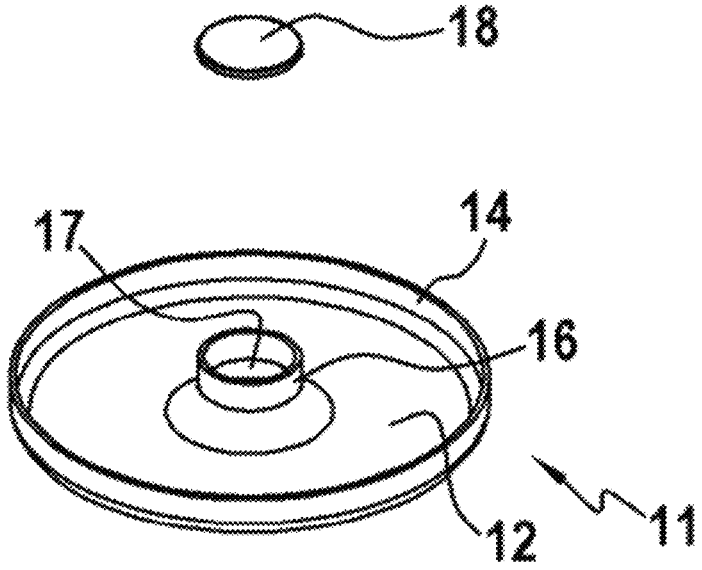
FIG. 1A illustrates, schematically and partially, a step of an example of a method for manufacturing a housing according to the invention.

FIG. 1A shows an example of a starting structure 11 which comprises a flat part 12 having a central orifice 17 delimited and surrounded by a hollow central neck 16. The flat part 12 can have a revolution shape. The central orifice 17 can be circular in shape. The flat shape 12 is intended to form the base of the first element 10 and the bottom of the charging volume as will be covered further on in the text. The flat part 12 can be intended to form the cover of the housing once its manufacturing is complete. The structure 11 further comprises an outer cylindrical wall 14 delimiting and surrounding the flat part 12 and located on the same side as the neck 16. In the illustrated example, the outer cylindrical wall 14 has a height which is substantially equal to the height of the neck 16. However, one does not depart from the scope of the invention if these two parts have different heights.

The orifice 17 is here closed by adding a first shutter disc 18 on the neck 16. The first shutter disc 18 can be fixed to the neck 16 by mechanical clamping. The shutter disc 18 can be mechanically clamped against the neck 16 and the first hollow central neck 20, particularly its annular attaching portion 22, which will be described below. The shutter disc 18 makes it possible to form a barrier, particularly against water and humidity, and also where applicable to outside agents such as oils. The shutter disc 18 can be made of polymer material, for example in the form of a polymer film, for example made of polyester. The thickness of the shutter disc 18 can be greater than or equal to 10 μm, for example between 10 μm and 100 μm. However, one does not depart from the scope of the invention when the shutter disc 18 is omitted.

Figure 1B:
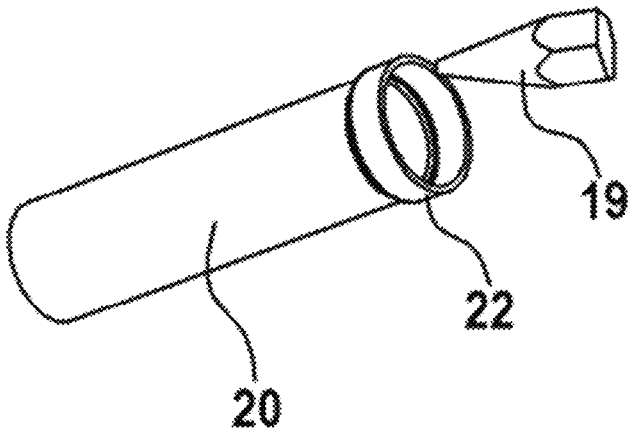
FIG. 1B illustrates, schematically and partially, a step of an example of a method for manufacturing a housing according to the invention.
Figure 1C:
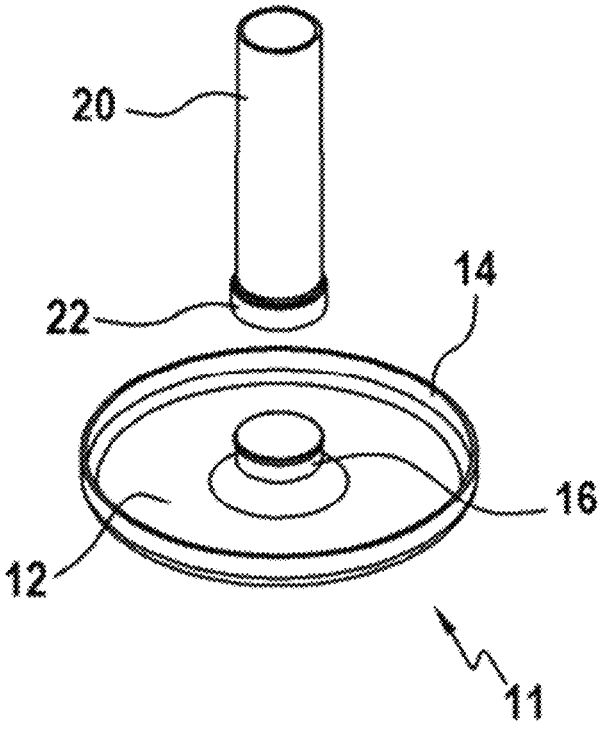
FIG. 1C illustrates, schematically and partially, a step of an example of a method for manufacturing a housing according to the invention.
Figure 1D:
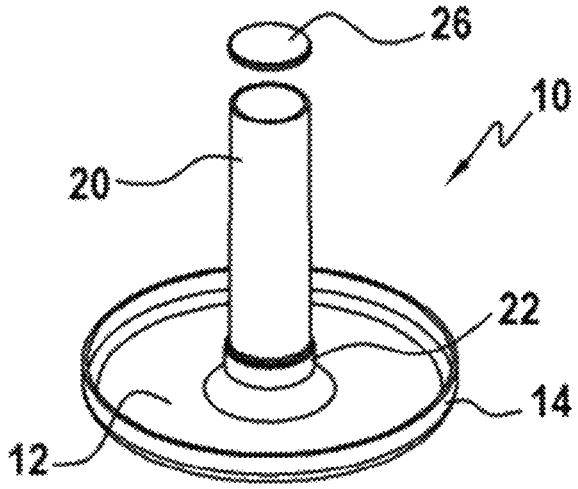
FIG. 1D illustrates, schematically and partially, a step of an example of a method for manufacturing a housing according to the invention.
Figure 2:
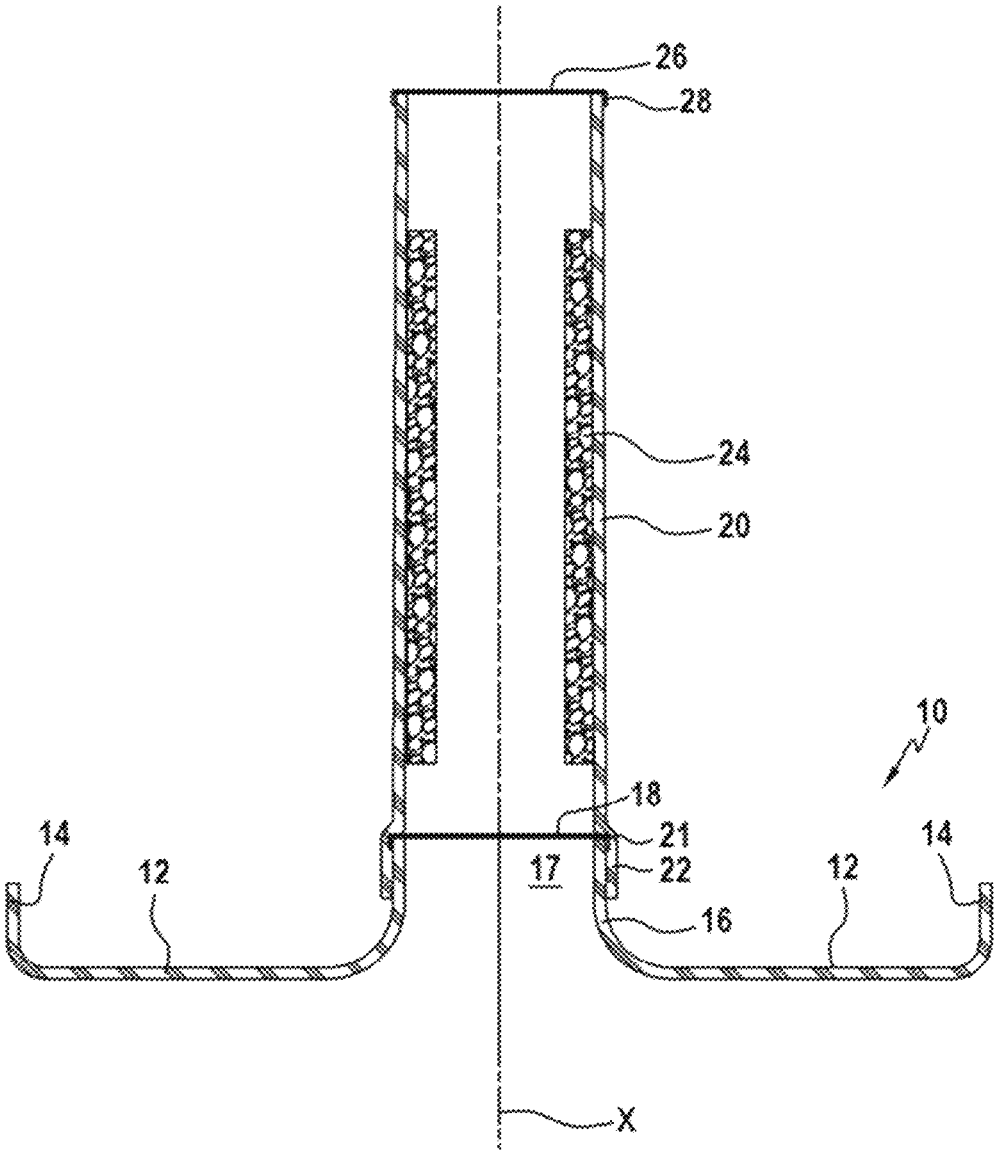
FIG. 2 is a section of an example of a first element of the housing to be obtained.

FIGS. 1B and 1C along with FIG. 2 illustrate the positioning and securing of the first hollow central neck 20 on the neck 16. The first neck 20 has been previously charged by a pyrotechnic composite such as to form an igniting tube for initiating the pyrotechnic charge of the housing. Thus, FIG. 2 particularly illustrates the inner structure of the first neck 20 wherein an igniting structure 24 is present. This igniting structure 24 is formed of an agglomerate of pyrotechnic grains in a binding agent. Such structures are known per se and do not need to be further detailed here. The first neck 20 is in the form of a hollow cylinder open at both its longitudinal ends and has a variation in section at the level of at least one of its longitudinal ends such as to define an annular attaching portion 22. The portion 22 is intended to cooperate with the neck 16 during the positioning of the first neck 20 on the flat part 12. The first neck 20 can have a section increased at the level of the longitudinal end intended to cooperate with the neck 16. The section of the first neck 20 varies at a position embodied by the reference symbol 21, visible in FIG. 2 in particular.

An adhesive is deposited using an applicator 19 on the attaching portion 22 then the first neck 20 is positioned on the neck 16 such as to make the neck 16 cooperate with the attaching portion 22 coated with adhesive. In the illustrated example, the adhesive is deposited on the inner surface of the attaching portion 22 and the neck 16 is inserted inside the attaching portion 22, as schematized in FIG. 1C and in FIG. 2. The bonding of the first hollow central neck 20 to the neck 16 makes it possible to provide a seal. Once inserted, the neck 16 can abut on the first neck 20 at the level of the position 21 of variation of the section (see FIG. 2). The height of the neck 16 can be greater than or equal to the height of the attaching portion 22. The first shutter disc 18 can be located inside the attaching portion 22 once the first neck 20 is positioned. The inner diameter of the attaching portion 22 can be substantially equal to the outer diameter of the neck 16.

After attaching the first neck 20 to the neck 16, a second shutter disc 26 can be secured on the longitudinal end of the first neck 20 opposite the first shutter disc 18. The second shutter disc 26 closes the first neck 20 (see FIG. 1D). The second shutter disc 26 can have the same features as the first shutter disc 18, described above. The reference symbol 28 in FIG. 2 indicates the adhesive used to secure the second shutter disc 26 to the first neck 20. One thus forms a first element 10 of the housing to be obtained, this first element 10 comprising the structure 11 forming a base of this first element 10 from which the first neck 20 extends along a longitudinal axis X. The first neck 20 extends transversally to the flat part 12, for example perpendicular to this latter.

An example of a first element 10 has just been described. There will now follow a series of possible steps for continuing the manufacturing of the housing by implementing this first element 10.

Figure 1E:
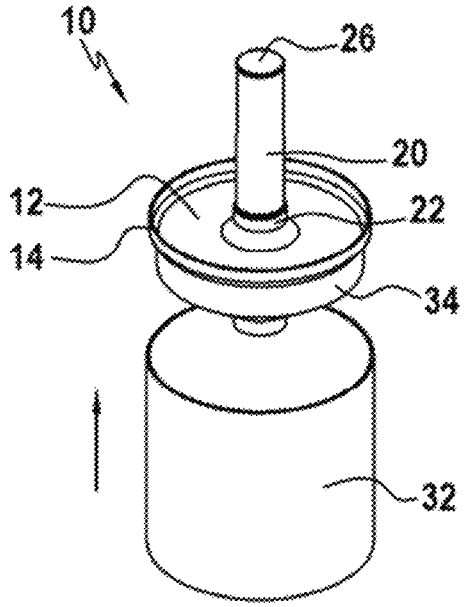
FIG. 1E illustrates, schematically and partially, a step of an example of a method for manufacturing a housing according to the invention.
Figure 3:
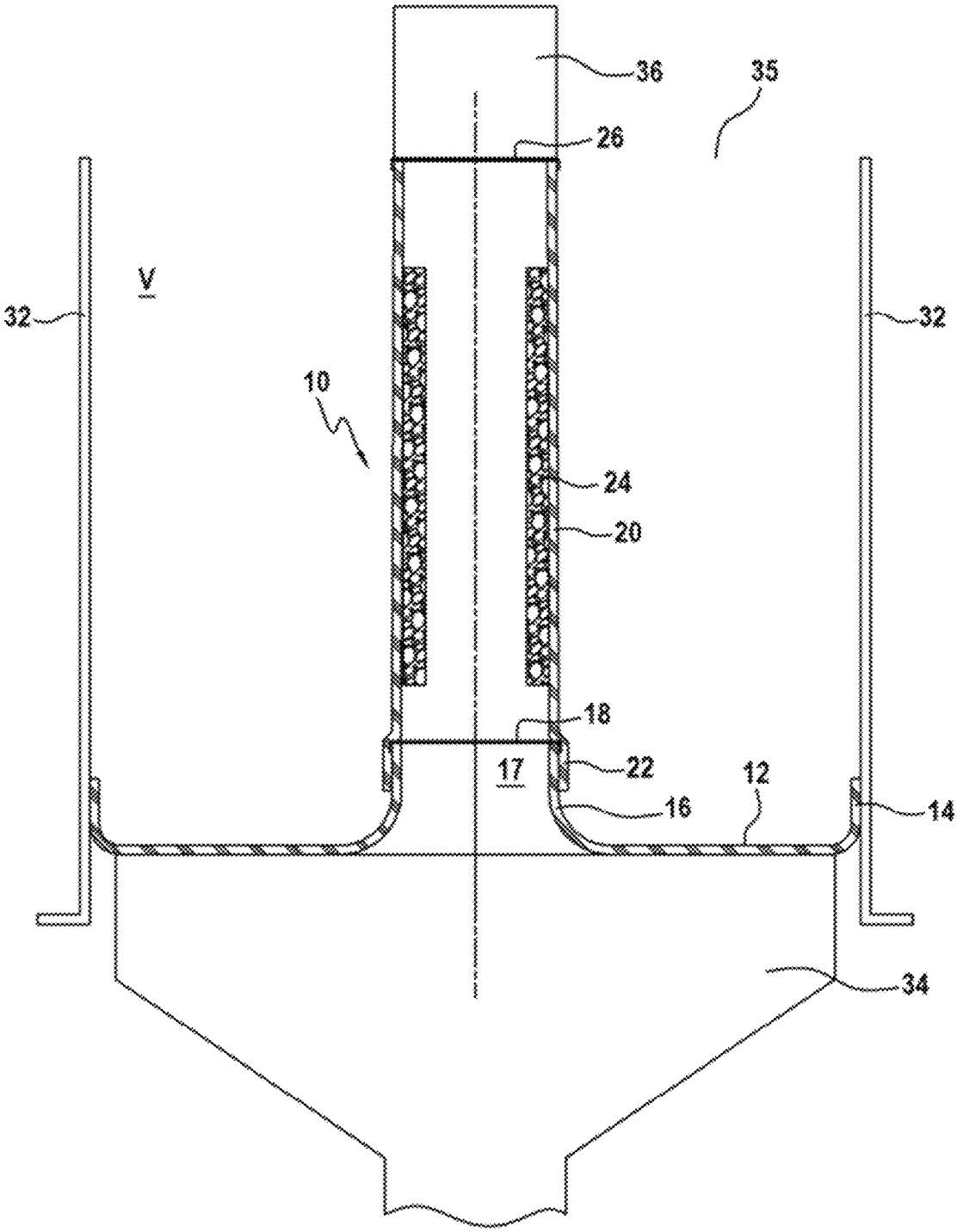
FIG. 3 is a section of the first element positioned such as to form a bottom of the charging volume.

First a charging volume V can be made having the shape and inner dimensions of the housing to be obtained. As illustrated in FIG. 3, this charging volume V is laterally delimited and surrounded by a rigid cylindrical charging wall 32. The charging volume V is further delimited by a support 34 in a lower part. The charging volume V has an open upper part 35. The upper part 35 is located on the opposite side to the support 34. FIG. 1E illustrates the positioning of the cylindrical wall 32 around the first element 10. This positioning can be done by translating the cylindrical wall 32 upward all the way to the level of the first element 10 which is positioned on the support 34, as illustrated in FIG. 1E.

FIG. 3 illustrates the configuration obtained after positioning the cylindrical wall 32 around the first element 10. The first element 10 defines a bottom of the charging volume V. The first element 10 can close the entirety of the lower part of the charging volume V. The charging volume V is delimited in its lower part by the first element 10. The outer cylindrical wall 14 can have an outer diameter substantially equal to the inner diameter of the cylindrical wall 32. An element 36 is then positioned on the first neck 20 after positioning the cylindrical wall 32. The element 36 can be made of polymer material, for example made of PEEK. The element 36 makes it possible to retain and rigidify the whole of the first neck 20 and of the first element 10, particularly during the phase of insertion of the pyrotechnic charge 40, and where applicable during a rotation and a vibration of the assembly. The element 36 is used during the method but is not part of the final product. In the illustrated example, the first neck 20 comes up to substantially the same height as the cylindrical wall 32. The height of the outer cylindrical wall 14 is meanwhile less than the height of the cylindrical wall 32.

An example has just been described in which the first element 10 is positioned on the support 34 before the cylindrical wall 32 is positioned. Of course, one does not depart from the scope of the invention if the first element 10 is positioned on the support 34 while the cylindrical wall 32 has already been positioned beforehand. The features described above are applicable to this non-illustrated variant.

Figure 1F:
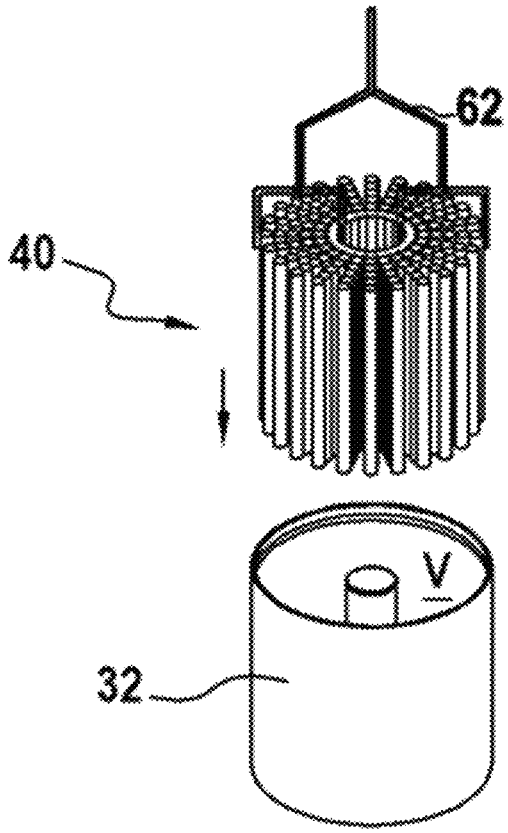
FIG. 1F illustrates, schematically and partially, a step of an example of a method for manufacturing a housing according to the invention.
Figure 4:
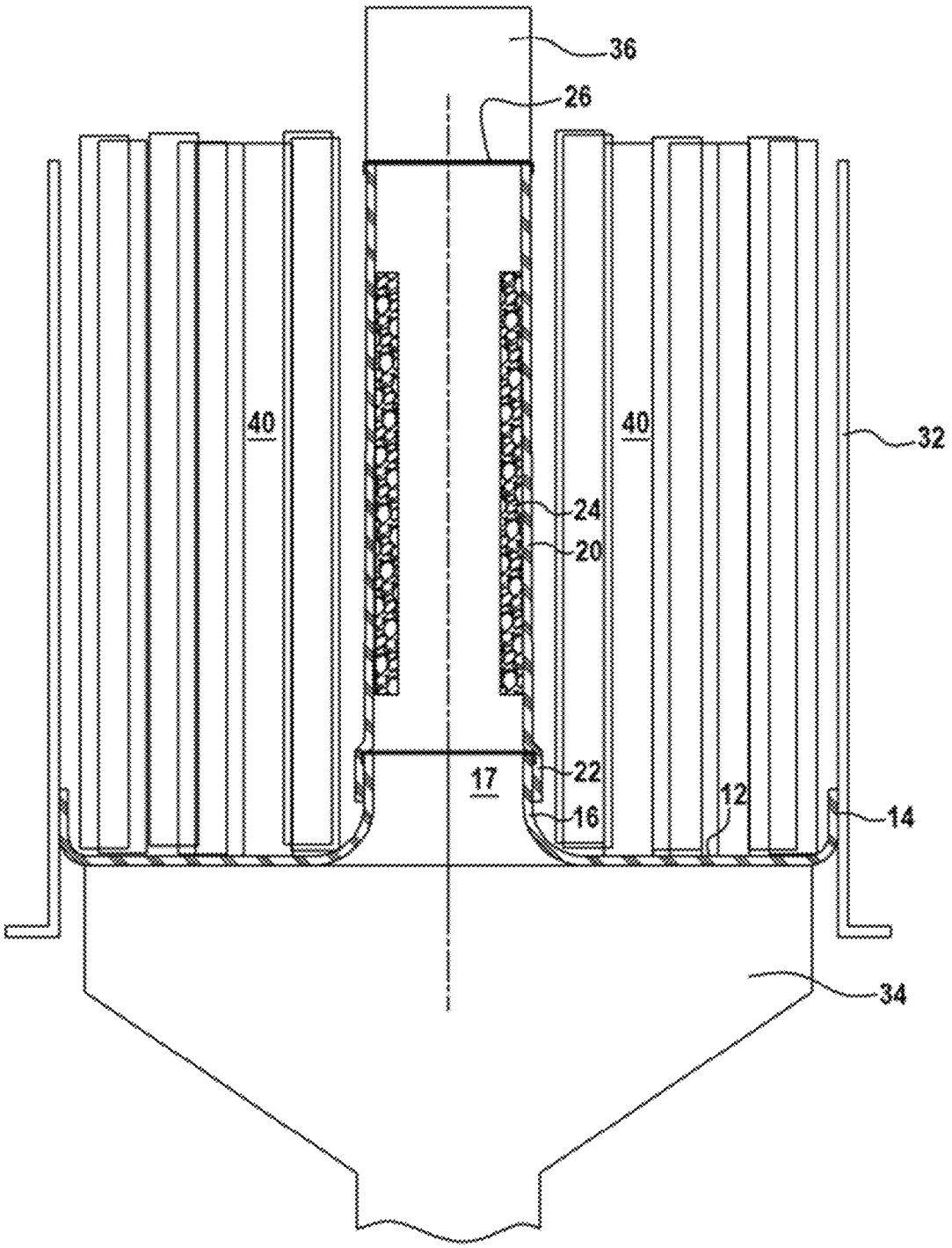
FIG. 4 is a section of the charging volume into which the pyrotechnic charge has been inserted on the first element.

The method continues by inserting the pyrotechnic charge 40 into the charging volume V through the open upper part 35. The pyrotechnic charge 40 is inserted onto the first element 10. In the illustrated example, the pyrotechnic charge 40 is in the form of a block inserted by translation using an inserting device 62 (see FIG. 1F and FIG. 4). The wall 32 and the support 34 can remain fixed during the insertion of the charge. In a variant, the insertion of the charge 40 into the volume V can be done by leaving the charge fixed and moving the support and the wall 32 toward the charge 40. Whatever its structure, the pyrotechnic charge 40 can be a propulsive charge for artillery ammunition, and the housing to be obtained can constitute a modular charge for artillery ammunition.

The charging volume V can be provided with an element making it possible to check the weight of the inserted charge 40 (not represented) for example by weighing. The charge 40 can fill at least half, for example at least three quarters, for example substantially the entirety of the volume V. As indicated above, the cylindrical wall 32 is rigid, i.e. it is not deformed during the insertion of the pyrotechnic charge 40. The cylindrical charging wall 32 can be made of metallic material, for example made of aluminum or made of aluminum alloy, or of steel, for example of stainless steel. The cylindrical wall 32 can be coated with an anti-wear coating, known per se, which makes it possible to adjust the roughness and the surface condition. The anti-wear coating can be a chemical nickel coating, or a deposit made by physical or chemical vapor phase deposition.

Figure 1G:
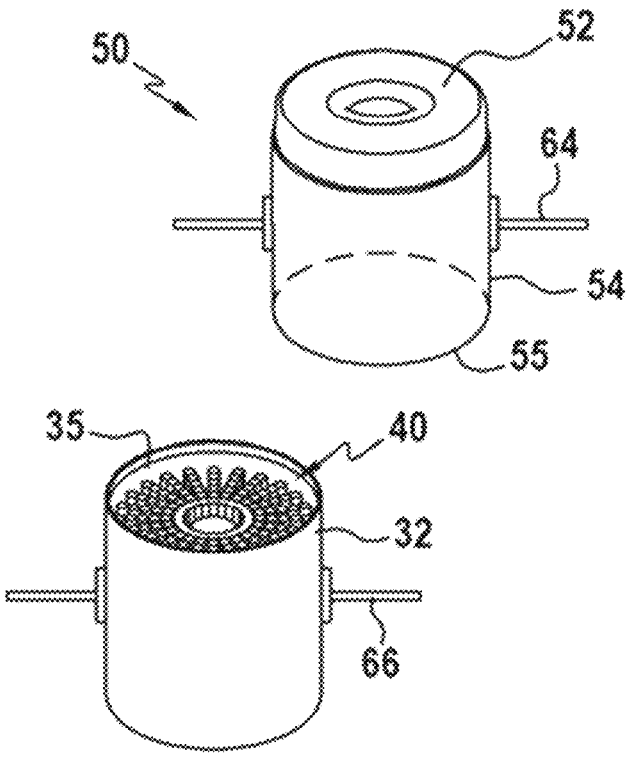
FIG. 1G illustrates, schematically and partially, a step of an example of a method for manufacturing a housing according to the invention.
Figure 5:
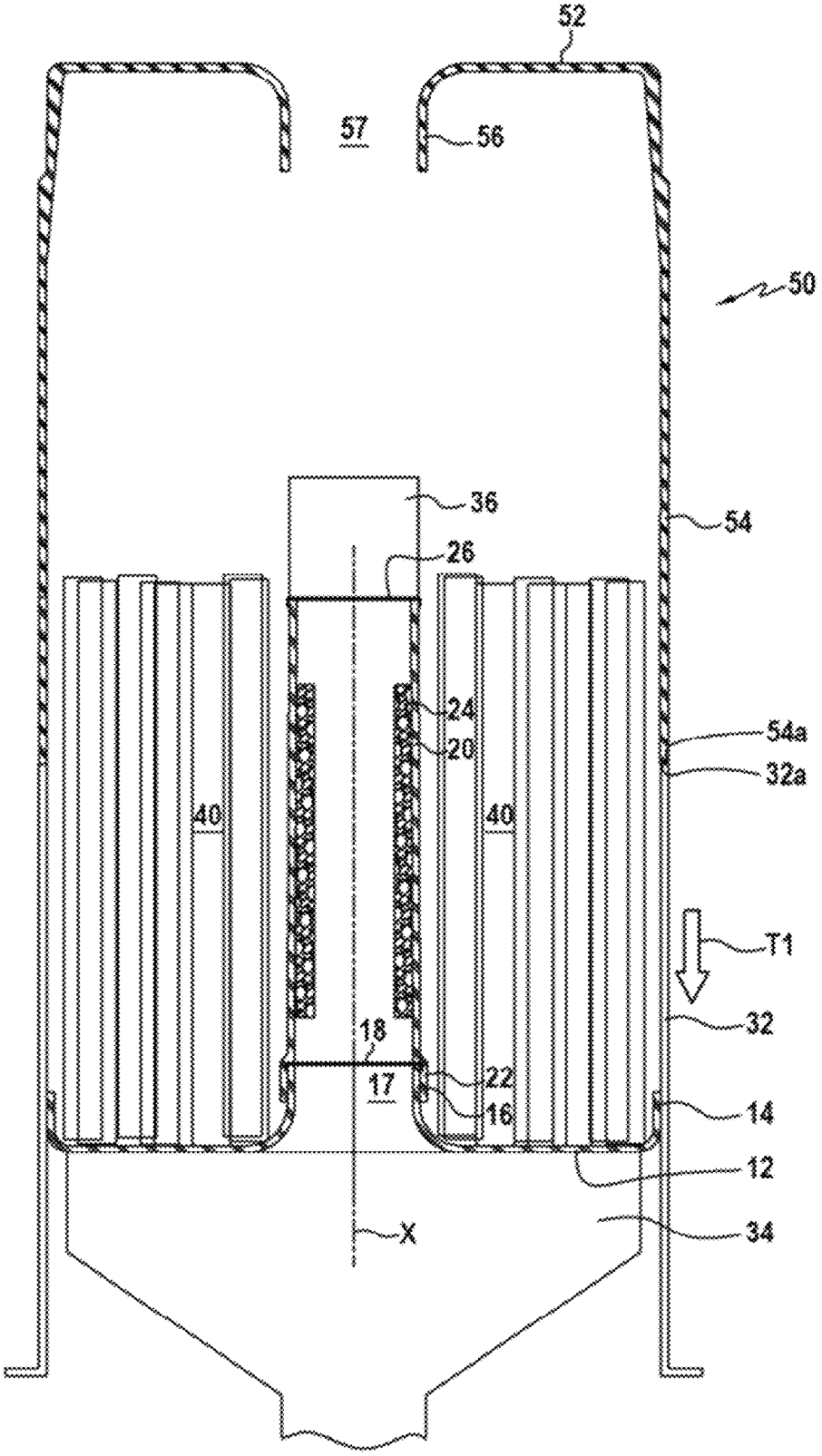
FIG. 5 is a section showing an example of a second element of the housing to be obtained, and the joint translation of the second element and of the charging wall relative to the support and to the first element.

After inserting the charge 40 into the volume V, a second element 50 of the housing to be obtained is positioned above the charge 40 using a moving device 64 (see FIG. 1G and FIG. 5). The second element 50 is able to cooperate with the first element 10 such as to obtain a closed housing enclosing the pyrotechnic charge 40. The second element 50 can be intended to form the body of the housing and to cooperate with the cover formed by the flat part 12 previously described.

The second element 50 has a cylindrical shape and comprises a flat part 52 having a central orifice 57 delimited and surrounded by a second hollow central neck 56. The flat part 52 can have a revolution shape. The central orifice 57 can be of circular shape. The flat part 52 forms the base of the second element 50 and the second neck 56 extends from the flat part 52. The second neck 56 extends transversally to the flat part 52, for example perpendicular to this latter. The second element 50 further comprises the flat part 52. The second neck 56 extends transversally to the flat part 52, for example perpendicular to this latter. The second element 50 further comprises a lateral cylindrical wall 54 delimiting and surrounding the flat part 52 and located on the same side as the second neck 56. The lateral cylindrical wall 54 has the same shape as the cylindrical charging wall 32, and a diameter equal to the diameter of the cylindrical charging wall 32. In the illustrated example, the lateral cylindrical wall 54 has a height which is greater than the height of the second neck 56. The cylindrical wall 54 can have a height greater than the height of the pyrotechnic charge 40. The cylindrical wall 54 is open at its end 55 opposite its base 52.

The second element 50 is positioned above the pyrotechnic charge 40 with the open end 55 of the cylindrical wall 54 of the side of the open upper part 35 of the charging volume V and the cylindrical wall 54 in the extension of the cylindrical wall 32. The lower edge 54*a* of the cylindrical wall 54 is facing, for example in contact, with the upper edge 32*a* of the cylindrical wall 32. The second neck 56 is moreover aligned with the first neck 20 along the longitudinal axis X.

After positioning the second element 50, a joint translation is made of the assembly formed by the second element 50 and the cylindrical wall 32 relative to the support 34 and to the first element 10. The assembly formed by the second element 50 and the cylindrical wall 32 are moved simultaneously and at the same speed relative to the support 34 and to the first element 10. This movement is embodied by the arrow T1 in FIG. 5 in particular. In the illustrated example, the support 34 remains fixed and the assembly of the second element 50 and of the cylindrical wall 32 are set in motion.

Figure 6:
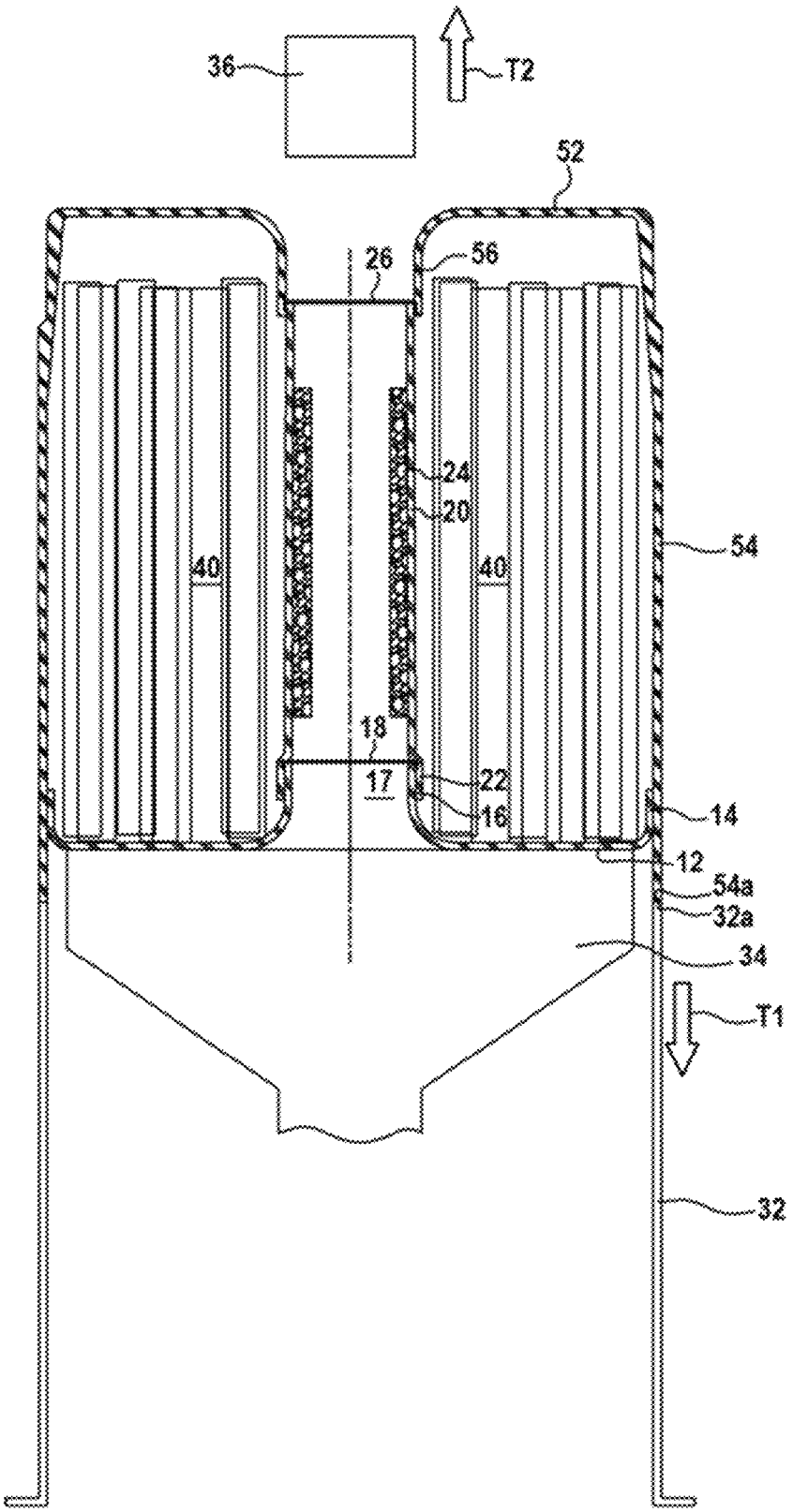
FIG. 6 is a section showing the configuration during the joint translation and the start of the cooperation of the second element with the first element.

The moving device 64 ensures the movement of the second element 50 and the cylindrical wall 32 is moved by a second moving device 66. During the joint translation, the first 10 and second 50 elements are brought closer together such as to make them cooperate and in particular insert the first element 10 inside the second element 50. FIG. 6 illustrates the configuration at a later time in the joint translation where it can be seen that the outer cylindrical wall 54 delimits and surrounds the charge 40 and the flat part 12 and there is the start of the insertion of the first neck 20 into the second neck 56. The outer surface of the first neck 20 is in contact with the inner surface of the second neck 56. The inner diameter of the second neck 56 is substantially equal to the outer diameter of the first neck 20. There is also cooperation of the outer cylindrical wall 14 with the cylindrical wall 54. The outer diameter of the outer cylindrical wall 14 is substantially equal to the inner diameter of the cylindrical wall 54. The element 36 is withdrawn (withdrawing arrow T2) at the start of the cooperation between the necks 20 and 56.

Figure 9:
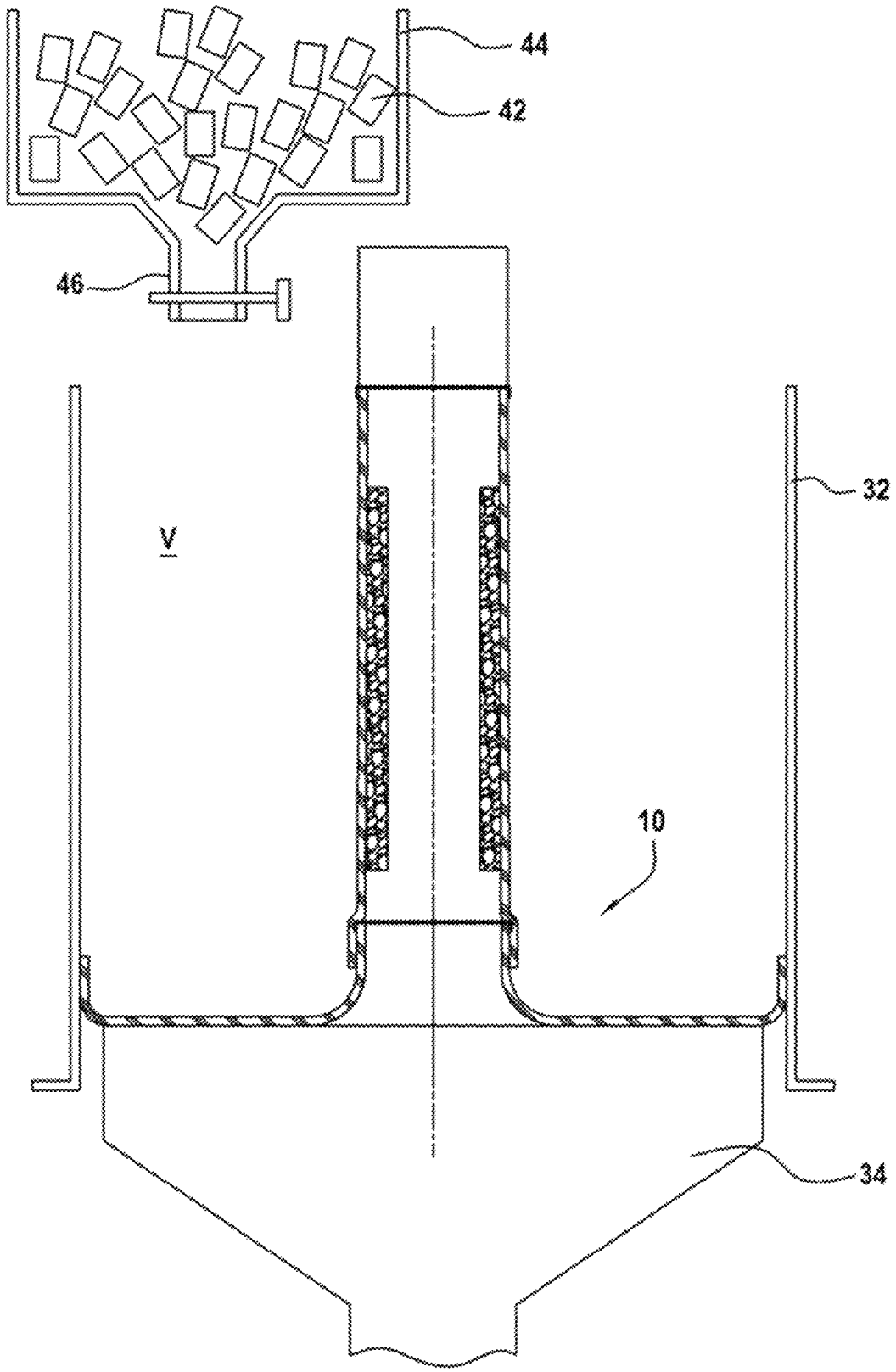
FIG. 9 illustrates a variant in which a granular pyrotechnic charge is implemented.

As indicated above, the example that has just been described relates to a fixed support 34 and a joint moving of the outer cylindrical wall 54 and of the cylindrical wall 32 but one does not depart from the scope of the invention if the cylindrical wall 54 and the cylindrical wall 32 remain fixed and the support 34 is translated all the way to the outer cylindrical wall 54. Furthermore, the invention is not limited to the use of a pyrotechnic charge 40 in the form of a block, in a variant it is possible to use a granular charge, the grains of which are of any shape. FIG. 9 illustrates this case by showing a granular charge 42 located in a reservoir 44 in communication with the charging volume V. A control unit (not shown) can control a metering device 46 such as to deliver the desired quantity of granular charge 42 into the charging volume. In this case, after inserting the charge 42 into the charging volume V surrounded by the rigid wall 32, one can proceed to an operation of packing of the grains 42, known per se. In the case of a granular charge, the wall 32 keeps this charge in a predefined shape following the insertion and packing. After the packing, one proceeds to the joint translation as described above such as to position the second element 50 around the granular charge 42. The invention is particularly beneficial in this case insofar as the operation of packing of the powder grains is liable to generate an unacceptable deformation of the housing body if it is carried out with the charge previously inserted into the housing body. This dispenses with any risk of deformation or damage during heaping. Moreover, the first 10 and second 50 elements can be obtained by a felting method, followed by compacting and stoving, of the type described in the document FR 2 710 976 by adapting the geometry of the areas of the mold where the suction takes place and the deposition of the fibers in the desired shape for the first 10 and second 50 elements. The first neck 20 can initially be formed of a single part with the flat part 52 of the second element 50, and then be cut up to be charged then positioned on the structure 11 as illustrated in FIG. 1C.

Figure 1H:
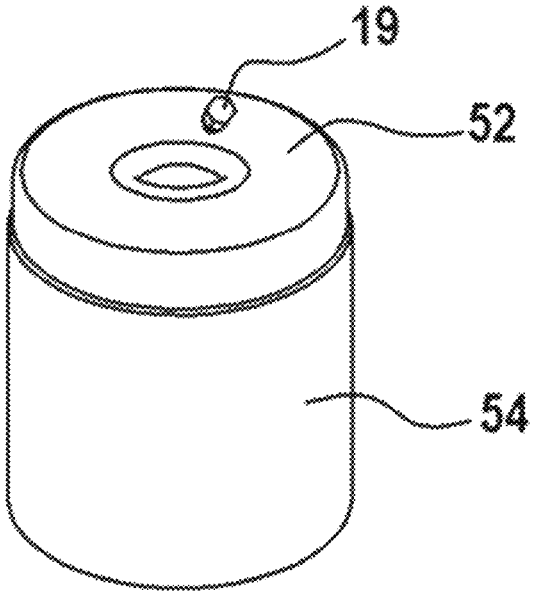
FIG. 1H illustrates, schematically and partially, a step of an example of a method for manufacturing a housing according to the invention.
Figure 7:
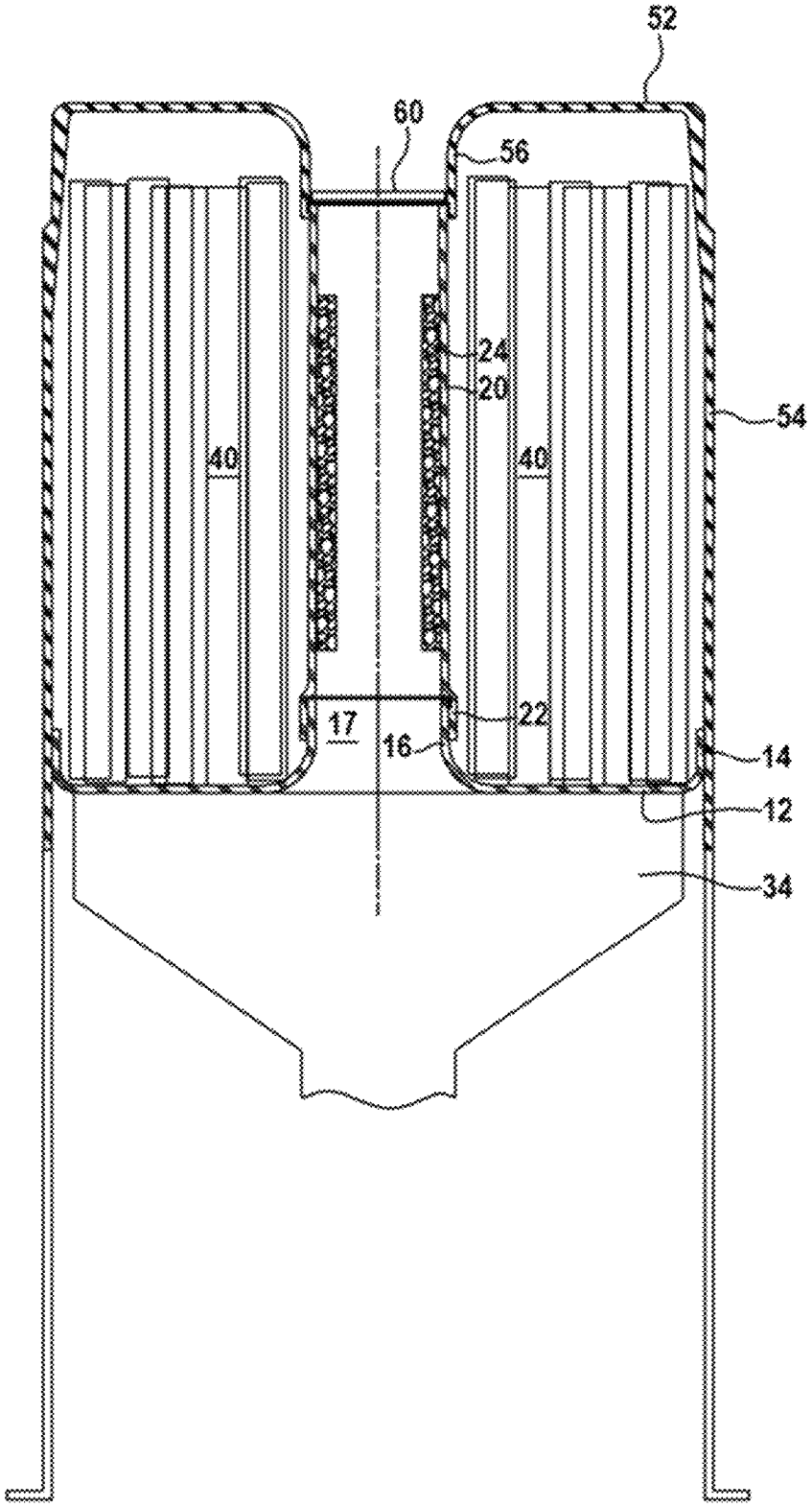
FIG. 7 is a section showing the deposition of adhesive to improve the securing between the first element and the second element.
Figure 8:
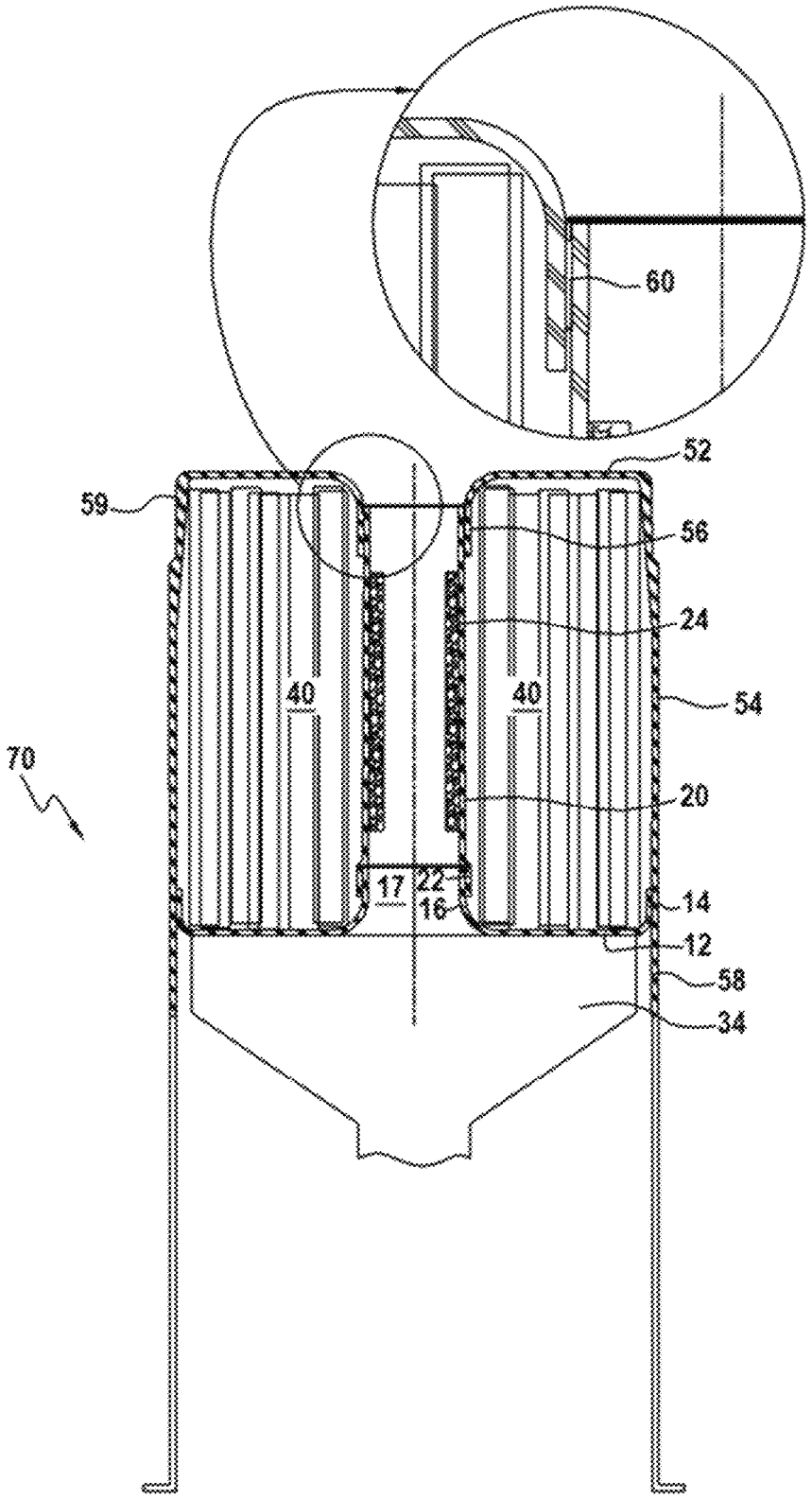
FIG. 8 is a section showing the configuration obtained once the joint translation is finished.

Before the end of the joint translation, an adhesive 60 is deposited on the first neck 20 such as to improve the securing to the second neck 56, the deposition of this adhesive is illustrated in FIG. 7 and in FIG. 1H. The joint translation is then finished so as to snap fit the first neck 20 inside the second neck 56. This gives the configuration illustrated in FIG. 8 with the adhesive present between the first neck 20 and the neck 56.

Thus assembled, the two elements of the housing define a cylindrical housing 70 closed at each of its ends, by a flat face with a central channel formed inside the first neck 20. The cylindrical wall 54 extends beyond the flat face 12 defining a hollow bush 58 beyond it.

Figure 1I:
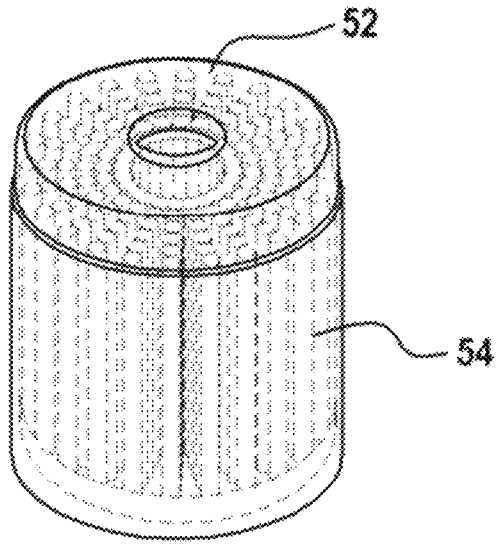
FIG. 1I illustrates, schematically and partially, a step of an example of a method for manufacturing a housing according to the invention.
Figure 1J:
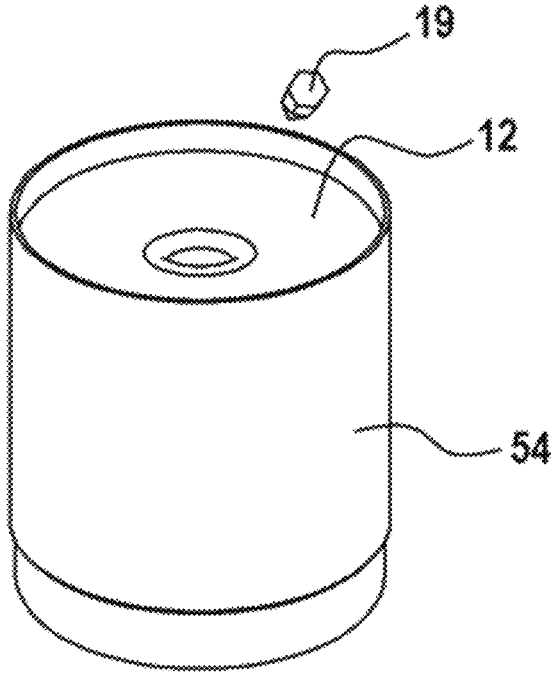
FIG. 1J illustrates, schematically and partially, a step of an example of a method for manufacturing a housing according to the invention.

The housing is then cut to dimensions (see FIG. 1I). The housing is then turned around and the deposition of adhesive using the applicator 19 can be done to further improve the connection between the first 10 and the second 50 elements (see FIG. 1J). During use, the flat face 52 can form the housing bottom (lower part of the housing) and the flat face 12 the cover of the housing (upper part of the housing). The cylindrical wall 54 forms the outer wall of the housing.

The cylindrical wall 54 shows on the side of the flat face 52 a recess 59 of a height and outer diameter such that the housing thus formed can be nested, via its recess, in the bush 58 of an underlying housing, for example during the constitution of a modular charge for artillery ammunition where several housings can be overlaid to give the weapon greater range.

The expression "between . . . and" must be understood as including the limits.

The invention claimed is:

1. A method for manufacturing a housing enclosing a pyrotechnic charge, said method comprising at least:

inserting a pyrotechnic charge into a charging volume laterally delimited by a rigid cylindrical charging wall and in a lower part by a first element of a housing to be obtained, positioning a second element of the housing to be obtained above the inserted pyrotechnic charge and in an extension of the cylindrical charging wall, said second element having a lateral cylindrical wall of the same shape and diameter as the cylindrical charging wall and being able to cooperate with the first element, and jointly translating the second element and the cylindrical charging wall relative to the first element so as to make the second element cooperate with the first element and form the housing enclosing the pyrotechnic charge.

2. The method as claimed in claim 1, wherein the first element comprises a first base and a first hollow central neck comprising an igniting structure and extending from the first base, and wherein the second element comprises a second base and a second hollow central neck extending from the second base, the second hollow central neck cooperating with the first hollow central neck following the joint translation.

3. The method as claimed in claim 1, wherein the method further comprises the manufacturing of each of the first and second elements, this manufacturing comprising at least:

felting on a liquid-permeable mold by suction of a felting bath comprising fibers in suspension and a resin, to obtain a blank of an element under consideration on the mold, and compacting the obtained blank and stoving this compacted blank.

4. The method as claimed in claim 1, wherein the pyrotechnic charge is a propulsive charge for artillery ammunition.

5. The method as claimed in claim 1, wherein the pyrotechnic charge is granular.

6. An installation for inserting a pyrotechnic charge into a charging volume laterally delimited by a rigid cylindrical charging wall and in a lower part by a first element of a housing, positioning a second element of cylindrical shape above the inserted pyrotechnic charge and in an extension of the cylindrical charging wall, said second element having a lateral cylindrical wall of the same shape and diameter as the cylindrical charging wall and being able to cooperate with the first element, and jointly translating the second element and the cylindrical charging wall relative to the first element so as to make the second element cooperate with the first element and form the housing with the housing enclosing the pyrotechnic charge, said installation comprising at least:

the charging volume laterally delimited by the rigid cylindrical charging wall and by the first element of the housing to be obtained on a support in the lower part, the pyrotechnic charge, an inserting device configured to insert the pyrotechnic charge into the charging volume, a moving system configured to position the second element above the charging volume and in the extension of the cylindrical charging wall, and perform the joint translation of the second element and of the cylindrical charging wall relative to the support, and a control unit configured to actuate the inserting device and the moving system.

7. The installation as claimed in claim 6, wherein the installation further comprises:

a felting bath comprising fibers in suspension and a resin, a liquid-permeable mold provided with a suction device to suck up the felting bath, a compacting and stoving system, and a second moving system configured to position the mold in the felting bath and to transport it from the felting bath to the compacting and stoving system.

8. The installation as claimed in claim 6, wherein the pyrotechnic charge is a propulsive charge for artillery ammunition.

9. The installation as claimed in claim 6, wherein the pyrotechnic charge is granular.

* * * * *